US012774123B2

(12) United States Patent
He et al.

(10) Patent No.: US 12,774,123 B2
(45) Date of Patent: Oct. 27, 2026

(54) WELDING DEVICE

(71) Applicant: ZHEJIANG WEIPAI PACKAGING EQUIPMENT CO., LTD., Taizhou (CN)

(72) Inventors: Yuhua He, Taizhou (CN); Shuibo Jiang, Taizhou (CN)

(73) Assignee: ZHEJIANG WEIPAI PACKAGING EQUIPMENT CO., LTD., Taizhou (CN)

( * ) Notice: Subject to any disclaimer, the term of this patent is extended or adjusted under 35 U.S.C. 154(b) by 0 days.

(21) Appl. No.: 19/116,809

(22) PCT Filed: May 26, 2023

(86) PCT No.: PCT/CN2023/096489
§ 371 (c)(1),
(2) Date: Mar. 28, 2025

(87) PCT Pub. No.: WO2024/066415
PCT Pub. Date: Apr. 4, 2024

(65) Prior Publication Data

US 2026/0103307 A1 Apr. 16, 2026

(30) Foreign Application Priority Data

Sep. 29, 2022 (CN) ..... 202222642696.0

(51) Int. Cl.
*B65B 13/32* (2006.01)

(52) U.S. Cl.
CPC ..... *B65B 13/327* (2013.01); *B65B 13/322* (2013.01)

(58) Field of Classification Search
CPC ..... B65B 13/322; B65B 13/327; B65B 13/32; B65B 13/187
(Continued)

(56) References Cited

U.S. PATENT DOCUMENTS 10,518,914 B2 * 12/2019 Neeser ..... B65B 13/322
2019/0389608 A1 * 12/2019 He ..... B65B 13/322

FOREIGN PATENT DOCUMENTS

CN 207917235 U 9/2018
CN 109398794 * 3/2019 ..... B65B 13/32
(Continued)

*Primary Examiner* — Linda J. Hodge
(74) *Attorney, Agent, or Firm* — MUNCY, GEISSLER, OLDS & LOWE, P.C.

(57) ABSTRACT

Disclosed is a welding device used for a handheld electric strapping machine, provided with a first motor and a second motor; the first motor is connected to the downward pressing and lifting motion assembly, so as to drive the upper welding member to press downwards and to be lifted upwards; the second motor is connected to the vibration driving assembly, so as to drive the upper welding member to vibrate, achieving heating and welding of packaging straps; the downward pressing and lifting motion assembly is also provided with a limiting member, the limiting member cooperating with a fixing structure on a handheld electric strapping machine and being used for preventing the upper welding member from going beyond the limit when the upper welding member descends to be in place. The welding device uses two motors for respectively and independently driving an upper welding plate to perform downward pressing and welding, thus facilitating manufacturing. After the downward pressing operation is finished, the limiting structure can be automatically locked by using counteracting force, thus ensuring that the upper welding plate is not lifted and loosened when the downward pressing and lifting operating motor is not operating, and ensuring a reliable process of welding.

9 Claims, 3 Drawing Sheets

(58) Field of Classification Search
USPC ..... 53/582, 592, 176; 100/29, 33 PB, 33 R
See application file for complete search history.

(56) References Cited

FOREIGN PATENT DOCUMENTS

| | | | | | |
|---|---|---|---|---|---|
| CN | 110723340 | | * | 8/2021 | ..... B65B 13/32 |
| CN | 113511385 | A | | 10/2021 | |
| CN | 114889877 | A | | 8/2022 | |
| CN | 218463941 | U | | 2/2023 | |
| JP | H6255611 | A | | 9/1994 | |
| KR | 102315930 | B1 | * | 10/2021 | ..... B65B 13/025 |
| WO | WO-2014194434 | A1 | * | 12/2014 | ..... B65B 13/32 |

* cited by examiner

WELDING DEVICE

FIELD OF THE INVENTION

The present invention relates to a welding device, and in particular to a packaging strap welding device for a portable strapping machine.

BACKGROUND OF THE INVENTION

In the handheld electric strapping machine, PET or PP strapping tape is used to strap products or packages, and the two parts of the strap to be bonded are heat-melted and bonded by friction. In the past, a handleless handheld electric strapping machine adopts a set of clutch matching parts, and the same motor is used to achieve the downward-pressing and vibrating friction of the welding plate. The clutch and reset structure are more complicated and precise. Therefore, there is a need for other approaches to realize the handleless handheld electric strapping machine to reduce the manufacturing difficulty.

SUMMARY OF THE INVENTION

It is an object of the present invention to provide a welding device used for a handheld strapping machine to weld a packaging strap. The device does not need to use a handle to lift and press down to control the upper welding plate, but can use a separate electric motor to drive the downward pressing and welding of the upper welding plate. For this purpose, the present invention adopts the following technical solutions:

A welding device used for a handheld electric strapping machine, comprising an upper welding member, a downward pressing and lifting motion assembly of the upper welding member, and a vibration driving assembly of the upper welding member connected to the downward pressing and lifting motion assembly of the upper welding member, wherein the welding device is provided with a first motor and a second motor; the first motor is connected to the downward pressing and lifting motion assembly, so as to drive the upper welding member to press downwards and to be lifted upwards; the second motor is connected to the vibration driving assembly, so as to drive the upper welding member to vibrate, achieving heating and welding of packaging straps; the downward pressing and lifting motion assembly is also provided with a limiting member, the limiting member cooperating with a fixing structure on a handheld electric strapping machine and being used for preventing the upper welding member from going beyond the limit when the upper welding member descends to be in place.

On the basis of adopting the above technical solutions, the present invention may further adopt the following technical solutions, or use these further technical solutions in combination:

The limiting member is maintained in a limited position by a counteracting force of the upper welding member during vibration to prevent reverse loosening.

The limiting member is arranged on a rotating component, and a position of the rotating component receiving the counteracting force on the rotating component is arranged such that, when the upper welding member moves downward, the counteracting force passes a critical point, such that the direction of the counteracting force is to press the limiting member downwards.

The downward pressing and lifting motion assembly includes a first lever, a second connecting rod, a third lever, and a lifting assembly; a first end of the first lever is rotatably connected to the top end of the lifting assembly, and a bottom of the lifting assembly is connected to the upper welding member; a second end of the first lever is rotatably connected to an upper end of the second connecting rod, and a lower end of the second connecting rod is rotatably connected to the third lever; the connecting position between the second connecting rod and the third lever is arranged such that, when the upper welding member is pressed downward to be in place, the connecting position moves from one side to the other side of a connecting line between a rotation fulcrum of the first lever and a rotation fulcrum of the third lever, while a limiting portion of the limiting member is positioned on the same side as the fulcrum of the third lever, the counteracting force transmitted through the second connecting rod can be used to press the limiting member downwards; another side of the third lever is provided with a gear, and the gear is in meshing connection with an output gear of the first motor.

The second motor is connected to an eccentric shaft, and the eccentric shaft is connected to a roller. The downward pressing and lifting motion assembly includes a lifting assembly, a connecting hole is arranged near a lower portion of the lifting assembly to be in fit with the roller, the lifting assembly is driven by the roller to vibrate, and the lower portion of the lifting assembly is connected to the upper welding member.

The welding device is provided with a base, and the lifting assembly comprises a piston and a vibrating rod, upper ends of the piston and the vibrating rod are rotatably connected via a shaft and are coaxially rotatably connected with the first end of the first lever; the base is provided with a vertical through-hole matching the lifting assembly, an upper portion of the through-hole is provided with a cylinder sleeve to slidably cooperate with the piston; the vibrating rod passes through the piston, a lower end of the vibrating rod is provided with an upper welding member, a connecting hole is provided near the lower portion of the vibrating rod to cooperate with the roller driving the vibrating rod; a supporting portion is arranged inside the through-hole of the base, and a compression spring is arranged between the supporting portion and the piston. The second connecting rod is an elastic rod.

The second connecting rod includes an upper connecting rod and a lower connecting rod, wherein the upper connecting rod or the lower connecting rod is connected to a core rod with a limit, and a sliding connection between the upper connecting rod and the lower connecting rod is achieved by means of the core rod; a compression spring is arranged between the upper connecting rod and the lower connecting rod; the upper connecting rod is rotatably connected to the first lever, and the lower connecting rod is rotatably connected to the third lever.

The welding device is provided with a sensing member cooperating with the limiting member, and the sensing member is pressed to be in place corresponding to the upper welding member and is used by the welding device to control the stopping of the first motor and the starting of the second motor.

The limiting member is provided with a downward limiting surface, and the welding device is provided with a base, and the base is provided with a structure matching with the limiting surface.

The vibrating rod is provided with a protective sleeve on a rod wall below the connecting hole.

Due to the adoption of the technical solution of the present invention, the welding device uses two motors for respectively and independently driving an upper welding plate to perform downward pressing and welding, thus facilitating manufacturing. After the downward pressing operation is finished, the limiting structure can be automatically locked by using counteracting force, thus ensuring that the upper welding plate is not lifted and loosened when the downward pressing and lifting operating motor is not operating, and ensuring a reliable process of welding.

DETAILED DESCRIPTION

Figure 1:
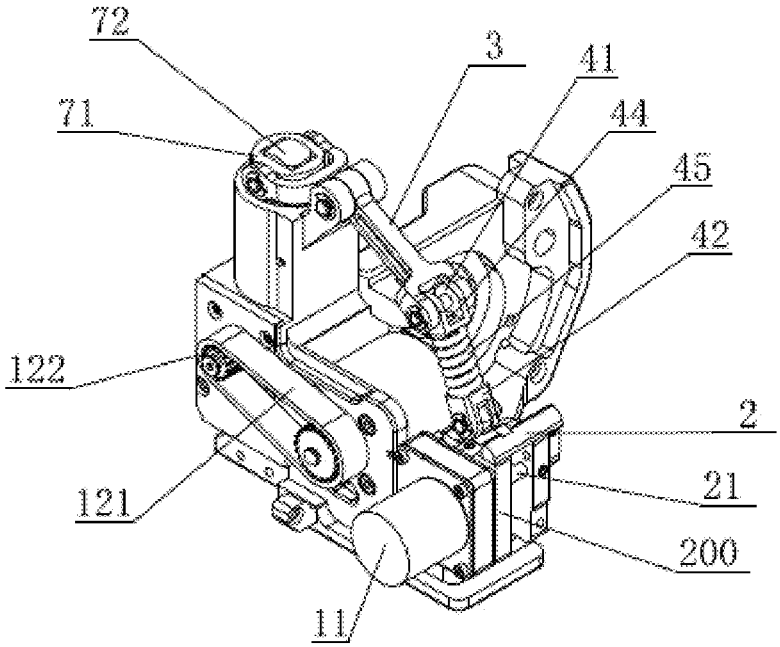
FIG. 1 is a schematic diagram according to an embodiment of the present invention.
Figure 2:
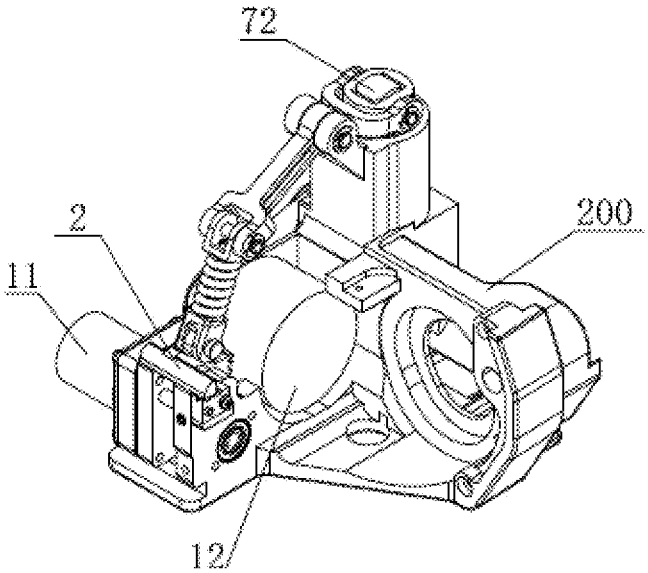
FIG. 2 is a schematic diagram observed from another angle according to an embodiment of the present invention.
Figure 3:
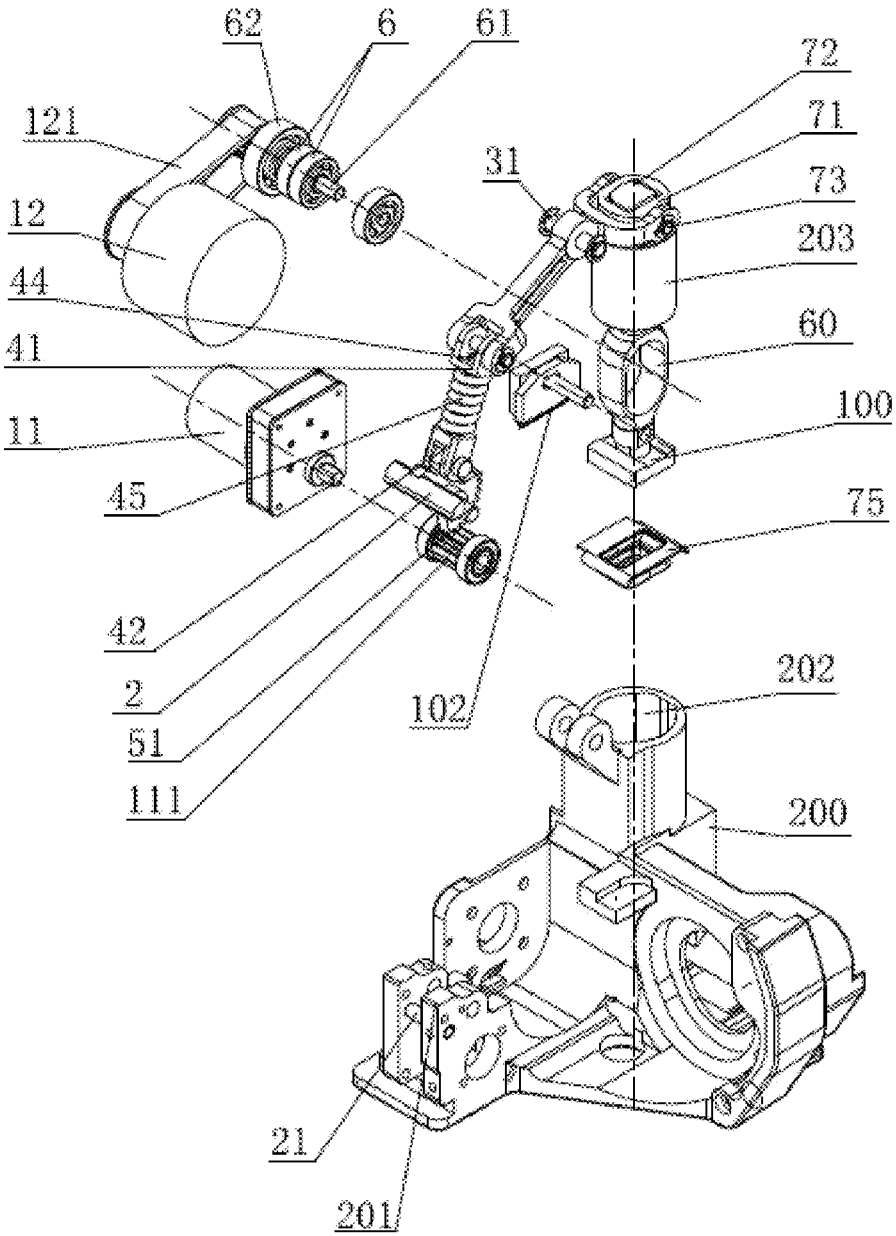
FIG. 3 is an exploded view of a structure according to an embodiment of the present invention.
Figure 4:
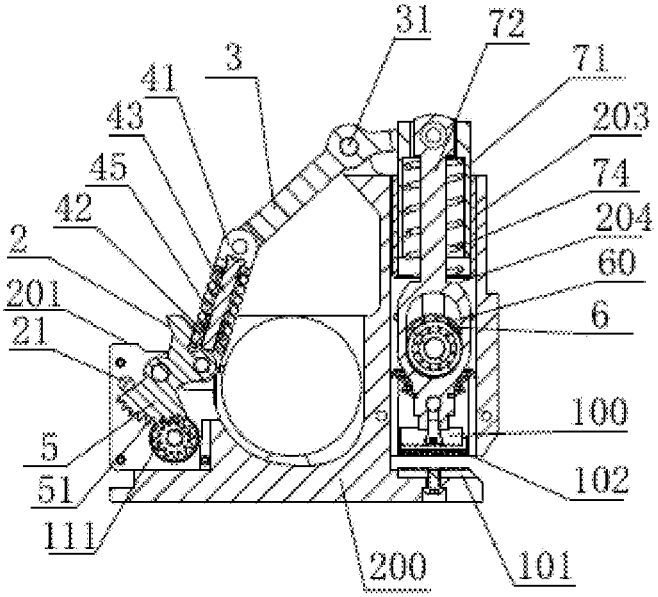
FIG. 4 is a cross-sectional view when an upper welding member is not pressed down according to an embodiment of the present invention.
Figure 5:
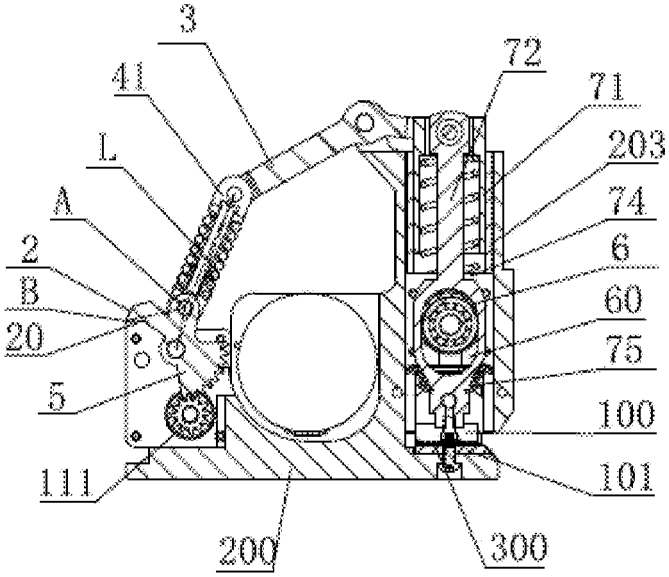
FIG. 5 is a cross-sectional view in a welding state according to an embodiment of the present invention.

Referring to figures, the present invention provides a welding device used for a handheld electric strapping machine, comprising an upper welding member 100, a downward pressing and lifting motion assembly of the upper welding member 100, and a vibration driving assembly of the upper welding member 100 connected to the downward pressing and lifting motion assembly of the upper welding member 100. The welding device is provided with a base 200. The reference numeral 101 represents a lower welding member arranged on the base, the reference numeral 102 represents a cutter fixed on a lifting assembly (vibrating rod 72) described below, and the reference numeral 300 represents a packaging strap welded between the upper welding member 100 and the lower welding member 101.

The welding device is provided with a first motor 11 and a second motor 12; the first motor 11 and the second motor 12 are both arranged on the base 200. The first motor 11 is connected to the downward pressing and lifting motion assembly, so as to drive the upper welding member 100 to press downwards and to be lifted upwards; the second motor 12 is connected to the vibration driving assembly, so as to drive the upper welding member 100 to vibrate, achieving heating and welding of packaging straps; the downward pressing and lifting motion assembly is also provided with a limiting member 2, the limiting member 2 cooperating with a portion 201 on the base 200 (or a structure fixedly connected to the base) and being used for preventing the upper welding member 100 from going beyond the limit when the upper welding member descends to be in place. The limiting member is provided with a downward limiting surface 20. The limiting member 2 is maintained in a limited position by the counteracting force of the upper welding member 100 during vibration to prevent reverse loosening. A limiting component 21 is also provided on the base and serves as a limiting component 21 when the downward pressing and lifting motion assembly drives the upper welding member 100 to rise.

The downward pressing and lifting motion assembly includes a first lever 3, a second connecting rod, a third lever 5, and a lifting assembly. The first lever is rotatably connected to a top of the base 200 by means of a shaft pin 31, a first end of the first lever 3 is rotatably connected to the top end of the lifting assembly, and a bottom of the lifting assembly is connected to the upper welding member 100; a second end of the first lever 3 is rotatably connected to an upper end of the second connecting rod, and a lower end of the second connecting rod is rotatably connected to the third lever 5. The limiting member 2 is arranged on the third lever 5 or is a part of the third lever; the connecting position between the second connecting rod and the third lever 5 is arranged such that, when the upper welding member is pressed downward to be in place, the connecting position A moves from one side to the other side of a connecting line L between a rotation fulcrum of the first lever 3 and a rotation fulcrum of the third lever, while a limiting portion B of the limiting member 2 positioned on the third lever 5 is positioned on the same side as the fulcrum of the third lever 5, the counteracting force transmitted through the second connecting rod can be used to press the limiting member 2 downwards, that is, when the upper welding member moves downward, the counteracting force receiving portion A of the third lever 5 passes a critical point, such that the direction of the counteracting force is to press the limiting member 2 downwards; another side of the third lever 5 is provided with a gear 51, and the gear 51 is in meshing connection with an output gear 111 of the first motor.

The second connecting rod is preferably an elastic rod. The second connecting rod includes an upper connecting rod 41 and a lower connecting rod 42, the lower connecting rod 42 is connected to a core rod 43 with a limit 44, and a sliding connection between the upper connecting rod 41 and the lower connecting rod 42 is achieved by means of the core rod 43, a compression spring 45 is arranged between the upper connecting rod 41 and the lower connecting rod 4, the compression spring 45 is sleeved on the core rod 43. The upper connecting rod 41 is rotatably connected to the first lever 3, and the lower connecting rod 42 is rotatably connected to the third lever 5.

The second motor 12 is connected to an eccentric shaft 61 by means of a transmission mechanism, and the eccentric shaft 61 is connected to a roller 6. The roller 6 can be a bearing. A connecting hole 60 is arranged near a lower portion of the lifting assembly to be in fit with (clearance fit) the roller 6, the lifting assembly is driven by the roller 6 to vibrate, and the lower portion of the lifting assembly is connected to the upper welding member 100.

The transmission mechanism includes a synchronous belt 121, a driving wheel of the synchronous belt 121 is connected to the second motor 12, one end of the eccentric shaft 61 is fixedly connected to a driven wheel 122 of the synchronous belt, and the eccentric shaft is rotatably connected to the base 200 by means of a bearing 62.

The lifting assembly includes a piston 71 and a vibrating rod 72, upper ends of the piston 71 and the vibrating rod 72 are rotatably connected via a shaft 73 and are rotatably connected with the first end of the first lever 3; the base 200 is provided with a vertical through-hole 202 matching the lifting assembly, an upper portion of the through-hole 202 is provided with a cylinder sleeve 203 to slidably cooperate with the piston 71; the vibrating rod 72 passes through the piston 71, a lower end of the vibrating rod 72 is provided with an upper welding member 100, a connecting hole 60 is provided near the lower portion of the vibrating rod 72 to be in fit with the roller 6; the vibrating rod 72 is provided with a protective sleeve 75 on a rod wall below the connecting hole 60; a supporting portion 204 is arranged inside the through-hole 202 of the base, and a compression spring 74 is arranged between the supporting portion 204 and the piston 71.

The welding device is provided with a sensing member cooperating with the limiting member 2; the sensing member can be a micro switch. The sensing member is pressed to be in place corresponding to the upper welding member 100 and is used by the welding device to control the stopping of the first motor 11 and the starting of the second motor 12.

Unless otherwise specified, in the description of the present invention, the orientation or position relationship indicated by terms such as "upper", "lower", "vertical", "horizontal", "top", "bottom", "inside", "outside", "axial", etc. is based on the orientation or positional relationship shown in the figures, and is only for the convenience of describing the present invention and simplifying the description, rather than indicating or implying that the indicated device or element must have the particular orientation, construction and operation in the particular orientation, therefore, the terms describing the orientation or position relationship in the present invention are only used for illustrative purposes and cannot be understood as limitations on the present invention. A person of ordinary skill in the art can understand the specific meaning of the above terms in combination with the accompanying drawings according to specific circumstances.

Unless otherwise clearly specified and limited, in the present invention, the terms "provided/arranged", "clamped" and "connected" should be construed in a broad sense, for example, it can be a fixed connection, a detachable connection, or an integral connection; it can be directly connected, or indirectly connected through an intermediate medium, or it can be internal communication between two elements. A person of ordinary skill in the art can understand the specific meaning of the above terms according to specific circumstances.

The foregoing description merely describes the specific embodiments of the present invention, but the structural features of the present invention are not limited thereto. Any changes or modifications made by those skilled in the art in the field of the present invention shall fall within the scope of protection of the present invention.

The invention claimed is:

1. A welding device used for a handheld electric strapping machine, comprising an upper welding member, a downward pressing and lifting motion assembly of the upper welding member, and a vibration driving assembly of the upper welding member connected to the downward pressing and lifting motion assembly of the upper welding member, wherein the welding device is provided with a first motor and a second motor; the first motor is connected to the downward pressing and lifting motion assembly, so as to drive the upper welding member to press downwards and to be lifted upwards; the second motor is connected to the vibration driving assembly, so as to drive the upper welding member to vibrate, achieving heating and welding of packaging straps; the downward pressing and lifting motion assembly is also provided with a limiting member, the limiting member cooperating with a fixing structure on a handheld electric strapping machine and being used for preventing the upper welding member from going beyond a limit when the upper welding member descends to be in place, wherein the downward pressing and lifting motion assembly comprises a first lever, a second connecting rod, a third lever, and a lifting assembly; a first end of the first lever is rotatably connected to a top end of the lifting assembly, and a bottom of the lifting assembly is connected to the upper welding member; a second end of the first lever is rotatably connected to an upper end of the second connecting rod, and a lower end of the second connecting rod is rotatably connected to the third lever; a connecting position between the second connecting rod and the third lever is arranged such that, when the upper welding member is pressed downward to be in place, the connecting position moves from one side to the other side of a connecting line between a rotation fulcrum of the first lever and a rotation fulcrum of the third lever, while a limiting portion of the limiting member is positioned on the same side as the fulcrum of the third lever, a counteracting force transmitted through the second connecting rod can be used to press the limiting member downwards; another side of the third lever is provided with a gear, and the gear is in meshing connection with an output gear of the first motor.

2. The welding device of claim 1, wherein the limiting member is maintained in a limited position by a counteracting force of the upper welding member during vibration.

3. The welding device of claim 1, wherein the limiting member is arranged on a rotating component, and a position of the rotating component receiving the counteracting force on the rotating component is arranged such that, when the upper welding member moves downward, the counteracting force passes a critical point, such that the direction of the counteracting force is to press the limiting member downwards.

4. The welding device of claim 1, wherein the second motor is connected to an eccentric shaft, and the eccentric shaft is connected to a roller, and wherein a connecting hole is arranged near a lower portion of the lifting assembly to be in fit with the roller, the lifting assembly is driven by the roller to vibrate, and the lower portion of the lifting assembly is connected to the upper welding member.

5. The welding device of claim 1, wherein the welding device is provided with a base, and the lifting assembly comprises a piston and a vibrating rod, upper ends of the piston and the vibrating rod are rotatably connected via a shaft and are coaxially rotatably connected with the first end of the first lever; the base is provided with a vertical through-hole matching the lifting assembly, an upper portion of the through-hole is provided with a cylinder sleeve to slidably cooperate with the piston; the vibrating rod passes through the piston, a lower end of the vibrating rod is provided with the upper welding member, a connecting hole is provided near a lower portion of the vibrating rod to cooperate with a roller driving the vibrating rod; a supporting portion is arranged inside the through-hole of the base, and a compression spring is arranged between the supporting portion and the piston.

6. The welding device of claim 5, wherein the vibrating rod is provided with a protective sleeve on a rod wall below the connecting hole.

7. The welding device of claim 1, wherein the second connecting rod is an elastic rod; the second connecting rod comprises an upper connecting rod and a lower connecting rod, wherein the upper connecting rod or the lower connecting rod is connected to a core rod with a limit, and a sliding connection between the upper connecting rod and the lower connecting rod is achieved by means of the core rod, a compression spring is arranged between the upper connecting rod and the lower connecting rod; the upper connecting rod is rotatably connected to the first lever, and the lower connecting rod is rotatably connected to the third lever.

8. The welding device of claim 1, wherein the welding device is provided with a sensing member cooperating with the limiting member, and the sensing member is pressed to be in place corresponding to the upper welding member and is used by the welding device to control stopping of the first motor and starting of the second motor.

9. The welding device of claim 1, wherein the limiting member is provided with a downward limiting surface, and the welding device is provided with a base, and the base is provided with a structure matching with the limiting surface.

* * * * *